United States Patent [19]

Steele

[11] Patent Number: 4,561,301

[45] Date of Patent: Dec. 31, 1985

[54] MINIATURE WIND SOCK ASSEMBLY

[76] Inventor: Stanley O. Steele, 19 W. 720 Pierce Rd., Itasca, Ill. 60143

[21] Appl. No.: 628,430

[22] Filed: Jul. 6, 1984

[51] Int. Cl.[4] ..... A63H 33/40; B65D 85/67; G01P 13/02

[52] U.S. Cl. ..... 73/188; 116/265; 206/389; 272/8 N

[58] Field of Search ..... 73/188, 189; 116/264, 116/209, 173, 265

[56] References Cited

U.S. PATENT DOCUMENTS

| | | | |
|---|---|---|---|
| 1,579,034 | 3/1926 | Roberts | 73/189 |
| 2,243,618 | 5/1941 | Brown | 73/188 X |
| 3,213,823 | 10/1965 | Levy et al. | 116/173 X |
| 3,972,302 | 8/1976 | Sherman | 116/28 R |
| 4,137,781 | 2/1979 | Andrus | 73/189 X |

*Primary Examiner*—Daniel M. Yasich
*Attorney, Agent, or Firm*—Dillis V. Allen

[57] ABSTRACT

A miniature wind sock assembly adapted to be coiled and inserted into a small plastic display container. The wind sock is supported on a spring mast in turn fixed to a spring base bracket that is designed to be attached either to standard bicycle handlebars or to standard adjustable headband hats.

10 Claims, 9 Drawing Figures

MINIATURE WIND SOCK ASSEMBLY

BACKGROUND OF THE INVENTION

Attention-attracting novelty items, some of which also have some utility, have achieved a considerable degree of commercial success over the last several decades in the United States as well as many foreign countries. Such novelty, or semi-novelty and utility items frequently take the form of pictorial T-shirts, pennants, flags, badges and banners. Many of these items such as flags and pennants have rigid masts originally constructed of wood that are not only subject to breakage, but also require a rather large shipping container for transport. Moreover, because of the mast length and the relatively low cost of the product, the flag assembly cannot be economically packaged in individual containers and retailers hesitate to purchase any product that is shipped in bulk form and not individually containerized for sale to the consuming public.

Another problem with masted semi-novelty products is that because most retailers will not handle such bulk packaged products, there is no readily definable channel of trade, and as a result they have had only limited sales success. Their size also precludes them from many channels of trade handling other novelty items such as coin-operated vending machines.

It is a primary object of the present invention to ameliorate the problems noted above in semi-novelty masted products.

SUMMARY OF THE PRESENT INVENTION

According to the present invention a miniature wind sock is provided that is adapted to be coiled and then inserted into a small plastic container for both shipment and display to the customer either at a retail outlet or in coin operated vending machines.

Toward these ends the present miniature wind sock includes a one-piece rigid plastic wind sock that has a downwardly opening projection that fits over the upper end of a coiled spring mast that has its lower end pressed into a fitting ia a one-piece flat spring bracket with an upwardly opening loop and a larger downwardly opening loop.

The bracket's upwardly opening loop receives one side of a strap in an adjustable plastic head strap, a standard strap found in many visor-type sport caps. This enables the wind sock assembly to be mounted on the rear of the owner's hat for full display to all without interfering with the user's sporting activities or vision. Such adjustable plastic head straps have a projection that fits through one of a series of apertures in an opposed strap to adjust the size of the headband. This projection, prior to being inserted into one of the apertures is simply pushed through an aperture in the bracket and then through the other strap so that the straps clamp against the bracket holding the entire wind sock assembly in a vertical position with the wind sock pointing in the direction of the user's head.

This bracket also has a downwardly opening loop that is sized to fit over and clamp against a standard handlebar of a bicycle which is a very accessible support for the wind sock.

An important aspect of the present invention is that the coil spring mast has sufficient flexibility so that the mast can be wound around the wind sock with the bracket and then inserted into a very small plastic container at the manufacturing location. This container holds the wind sock assembly in the coiled position during shipment as well as during display to potential customers either in retail outlets and commercial coin operated vending machines.

DETAILED DESCRIPTION OF THE PREFERRED EMBODIMENT

Figure 1:
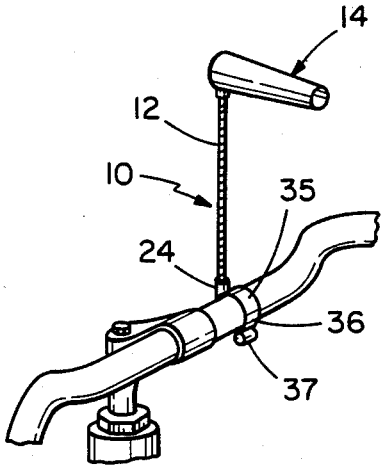
FIG. 1 is a perspective view of part of a handlebar assembly with the present wind sock assembly mounted on the handlebar.

Referring to the drawings, a wind sock assembly 10 is illustrated and is seen to include a flat spring lower bracket 11, a closely coiled spring wire mast 12, and a wind sock 14 mounted on the upper end of the mast 12.

Figure 4:
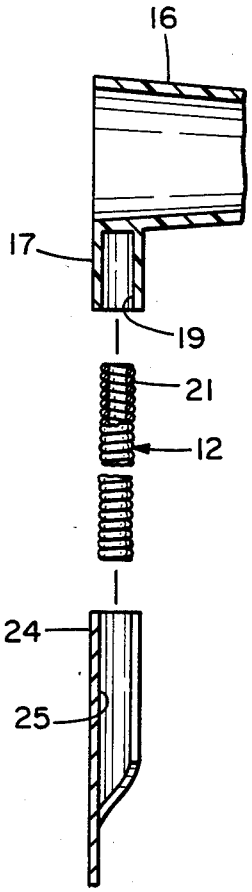
FIG. 4 is a fragmentary exploded view taken generally along line 4—4 of FIG. 3.

The wind sock 14 is a one-piece rigid plastic injection molding and is seen to include a frusto-conical body 16 with an annular boss projection 17 extending downwardly integrally from the body portion 16. As seen in FIG. 4 the projection 17 has an internal bore 19 that receives with a slight interference fit upward end 21 of spring mast 12. The spring mast 12 may, for example, be constructed of 0.018 inch wire, have a length of 4¼ inch and an outer diameter of 5/16 inch. In this way the wind sock boss 17 may be pressed on the spring 12 without the need for special tools or any adhesive whatsoever simplyfying its manufacture.

Figure 2:
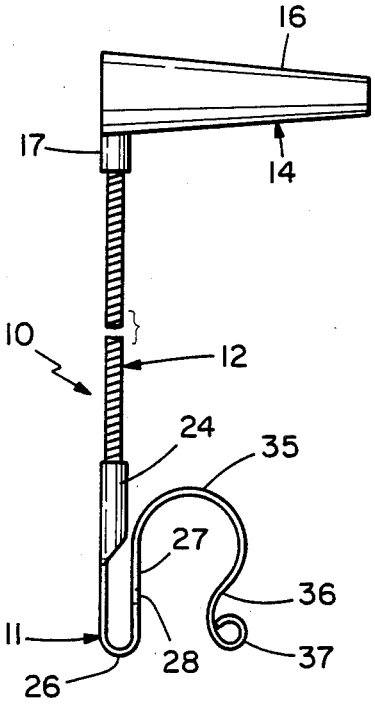
FIG. 2 is an enlarged side view of the wind sock assembly illustrated in FIG. 1.
Figure 3:
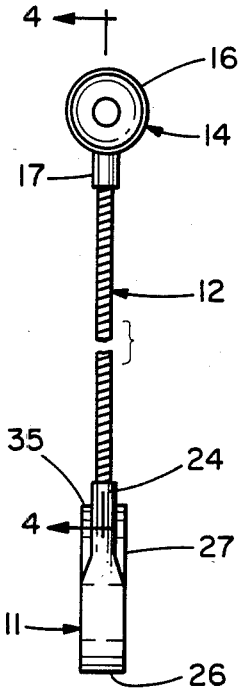
FIG. 3 is a rear view of the wind sock assembly illustrated in FIG. 2.

The bracket 11 is constructed of flat steel stock bent to the configuration illustrated in the drawings and then hardened to provide the bracket with the next necessary spring characteristics. This flat stock is bent into an annular shape forming fitting 24 with a internal diameter 25 slightly less than the spring mast 12 so that the spring mast may be pressed into the fitting 24 also without any special adhesives. Bracket 11 also includes an upwardly opening loop 26 that has a vertical leg 27 with an aperture 28 therein seen in both FIGS. 2 and 7.

Figure 5:
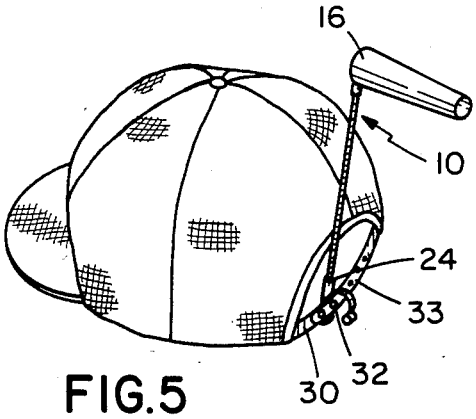
FIG. 5 is a perspective view of the wind sock assembly mounted on a standard adjustable head strap.
Figure 6:
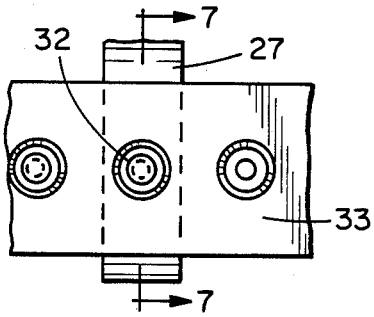
FIG. 6 is an enlarged fragmentary rear view of the standard head strap illustrated in FIG. 5 and the wind sock bracket.
Figure 7:
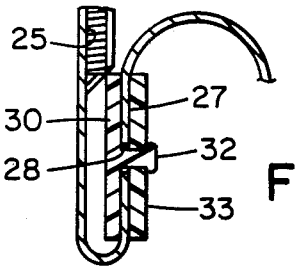
FIG. 7 is a fragmentary section taken generally along line 7—7 of FIG. 6 illustrating the adjustable head band connection to the bracket in the present wind sock bracket.

As seen in FIG. 7, when it is desired to mount the wind sock 10 on the rear of a hat with a standard adjustable head band, strap 30 is positioned against the forward surface of bracket leg 27 with strap post 32 inserted through aperture 28, and thereafter through one of the apertures in cooperating strap 33. In this way the straps squeeze against bracket 27 holding the entire wind sock assembly in the position illustrated in FIG. 5 with the wind sock pointed in the direction of the user's head.

The bracket 11 has a downwardly opening arcuate loop 35 that is sized somewhat smaller than the diameter of a standard handlebar, and this loop continues into a reverse bend portion 36 with a distal end loop 37. The reverse loop 37 acts as a camming surface to open the loop 35 as the bracket snapped over a handlebar as illustrated in FIG. 1.

Figure 8:
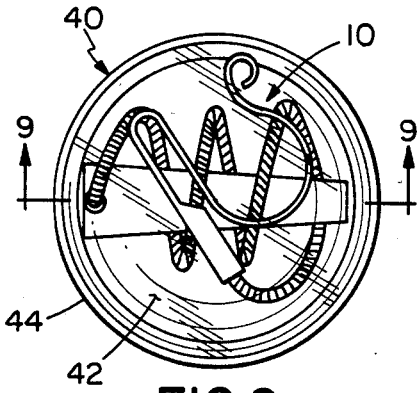
FIG. 8 is a top view of a semi-spherical plastic container according to the present invention with the wind sock assembly in its coiled position.
Figure 9:
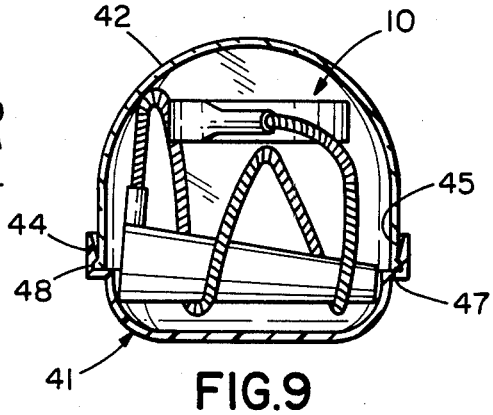
FIG. 9 is a cross-section of the present plastic container taken generally along line 9—9 of FIG. 8.

As seen in FIGS. 8 and 9, a plastic container 40 is provided for the present wind sock and is seen to include a lower base 41 and an upper transparent semi-spherical cover 42. The base 41 has an annular integral flange 44 with a tapered lead-in-surface 45 and an annular radial extending locking groove 47. The transparent cover 42 has a lower annual rim 48 that is cammed radially inwardly by surface 45 as the cover 42 is pushed into base 41. As rim 48 passes surface 45 it snaps into groove 47 locking cover 42 to base 41.

An important aspect of the present invention is that the container 40 has an inside diameter only slightly greater than the length of the wind sock 14 and the wind sock is held by the container in a coiled position, thus requiring a far smaller container than would be required to package it in its relaxed state illustrated in FIGS. 1 to 4. After manufacture, the manufacturer's packaging facility coils the mast 12 around the wind sock 14 and inserts it into the cover 42. The cover holds it in the coiled condition as the base 41 is inserted over the open end of the cover 42.

I claim:

1. A miniature wind sock, comprising: a bracket adapted to be releasably attached to a support, a flexible spring mast fixed to and extending upwardly from the bracket, and a frusto-conical wind sock connected to the upper end of the flexible spring mast, said mast having a flexible length at least three times the diameter of the wind sock and being sufficiently flexible so that the bracket and mast may be easily manually wound around the wind sock for insertion into a small container and then instantly unwound upon removal from the container.

2. A miniature wind sock as defined in claim 1, wherein the mast is a closely coiled spring.

3. A miniature wind sock as defined in claim 1, wherein the wind sock includes a one-piece rigid plastic molding having an annular projection adapted to fit over the upper end of the spring mast.

4. A miniature wind sock as defined in claim 1, wherein the bracket is constructed from a flat spring and has a loop adapted to fit over and grip a standard bicycle handlebar.

5. A miniature wind sock as defined in claim 1, wherein the bracket has an upwardly opening loop having flat sides adapted to grip a horizontal strap.

6. A miniature wind sock as defined in claim 1, wherein the bracket is constructed of a flat spring and has an upwardly opening loop adapted to receive a horizontal strap for support, and a downwardly opening larger loop adapted to fit over and grip a standard bicycle handlebar.

7. A miniature wind sock as defined in claim 6, wherein the upwardly opening loop has an aperture therein sized to receive a post on a standard adjustable length plastic headband.

8. A miniature wind sock and container assembly, comprising; a rigid plastic container including a base and a cover releasably connectable to the base, a wind sock assembly positioned within the container including a wind sock having a flexible spring mast fixed at one end thereto and wound around the wind sock, said spring mast having a flexible portion at least three times the diameter of the wind sock and being sufficiently flexible so that it may be easily wound around the wind sock and then instantly unwound, and a bracket adapted to be releasably attached to a support fixed to the other end of the spring mast, whereby the container need only have a length slightly greater than the length of the wind sock.

9. A container and miniature wind sock assembly as defined in claim 8, wherein the bracket is constructed of a single flat spring and has an upwardly opening loop having a less than ⅛ inch opening and adapted to receive an adjustable horizontal head strap means having a first strap with a plurality of holes therein and a second strap connectable thereto having an integral post adapted to engage in one of the holes in the first strap, said upwardly opening loop having an aperture therein sized to receive the post of the second strap, and said bracket having a downwardly opening larger loop adapted to fit over and grip a standard bicycle handlebar.

10. A miniature wind sock and container assembly, comprising; a rigid plastic container including a base and a cover releasably connectable to the base, a wind sock assembly positioned within the container including a wind sock having a flexible spring mast fixed at one end thereto and wound around the wind sock, said spring must having a flexible portion at least three times the diameter of the wind sock and being sufficiently flexible so that it may be easily wound around the wind sock and then instantly unwound, and a bracket adapted to be releasably attached to a support fixed to the other end of the spring mast, whereby the container need only have a length slightly greater than the length of the wind sock, said bracket being constructed of a flat spring and having an upwardly opening loop adapted to receive a horizontal head strap, said upwardly opening loop having an aperture therein sized to receive a post of a standard adjustable length head strap, and said bracket having a downwardly opening larger loop adapted to fit over and grip a standard bicycle handlebar.

* * * * *